US010746408B1

(12) United States Patent
Goin

(10) Patent No.: US 10,746,408 B1
(45) Date of Patent: Aug. 18, 2020

(54) PORTABLE STOVE AND/OR FIRE PIT

(71) Applicant: Samuel Eric Goin, Bakersfield, CA (US)

(72) Inventor: Samuel Eric Goin, Bakersfield, CA (US)

( * ) Notice: Subject to any disclaimer, the term of this patent is extended or adjusted under 35 U.S.C. 154(b) by 0 days.

(21) Appl. No.: 16/130,315

(22) Filed: Sep. 13, 2018

Related U.S. Application Data

(60) Provisional application No. 62/560,554, filed on Sep. 19, 2017.

(51) Int. Cl.

| | |
|---|---|
| ***F24C 1/16*** | (2006.01) |
| ***F24B 5/02*** | (2006.01) |
| ***F23B 20/00*** | (2006.01) |
| ***F23B 30/00*** | (2006.01) |

(52) U.S. Cl.
CPC ..... *F24B 5/028* (2013.01); *F23B 7/002* (2013.01); *F23B 20/00* (2013.01)

(58) Field of Classification Search
CPC .. F24C 1/16; F24B 5/028; F24B 1/202; F23B 7/002; F23B 20/00; A47J 33/00
See application file for complete search history.

(56) References Cited

U.S. PATENT DOCUMENTS 2,488,014 A * 11/1949 Higman ..... F24B 1/202 126/59
2,517,254 A * 8/1950 Steele ..... F24B 1/202 126/93
2,939,773 A * 6/1960 Rymer ..... A47J 37/079 126/65
3,765,397 A * 10/1973 Henderson ..... A47J 37/0763 126/25 R
4,026,265 A * 5/1977 Spadaro ..... A47J 37/079 126/25 B
5,682,872 A * 11/1997 Whitted ..... F24C 1/16 110/241
5,842,463 A * 12/1998 Hall ..... A47J 33/00 126/9 R
5,915,371 A * 6/1999 Hering ..... F24C 1/16 126/30
6,520,173 B2 * 2/2003 Lautner ..... A47J 33/00 126/25 B
6,615,821 B1 * 9/2003 Fisenko ..... A47J 37/0704 126/15 R (Continued)

*Primary Examiner* — Alfred Basichas
(74) *Attorney, Agent, or Firm* — James M. Duncan; Scanlon Duncan LLP

(57) ABSTRACT

A portable camping stove/fire pit has a cylindrical combustion chamber having a bottom member and circularly configured vertical side wall which extends upwardly from the bottom member and terminates in a top edge. The circularly configured side wall has a plurality of spaced apart vertically oriented slots, where each of the slots extends from the exterior of the combustion chamber into the interior. The circularly configured side wall has a plurality of vertically aligned louver members disposed in a spiraling configuration about the combustion chamber, where each louver is disposed tangentially to a respective vertical slot. During combustion within the combustion chamber, a flow of air is drawn past the plurality of vertically aligned louver members, through the slots into the interior, thereby forming a vortex as combustion occurs within the combustion chamber.

17 Claims, 8 Drawing Sheets

(56) References Cited

U.S. PATENT DOCUMENTS

| | | | | |
|---|---|---|---|---|
| 7,107,983 | B1 * | 9/2006 | West | A47J 33/00 126/25 R |
| 2007/0039603 | A1 * | 2/2007 | Lindsly | A47J 33/00 126/38 |
| 2019/0145625 | A1 * | 5/2019 | Satterley | F24C 1/16 126/9 R |

* cited by examiner

PORTABLE STOVE AND/OR FIRE PIT

RELATED APPLICATIONS

This application claims domestic priority to U.S. Provisional Application 62/560,554 filed Sep. 19, 2017.

BACKGROUND OF THE INVENTION

The presently disclosed invention generally pertains to portable combustion devices utilized for cooking, providing heat, and general ambience, where the combustion device consumes a fuel such as wood logs, branches, twigs, chips, paper, cardboard, and other types of combustible fibrous materials (hereinafter collectively referred to as a "wood product").

Combustion devices, such as barbeques and fire pits, have been used for many years to provide heat and light which are enjoyed for warmth, cooking, and general ambience. In particular, campers utilize camp fires to provide the aforementioned benefits. However, as experienced by many campers, the camp fire can provide less than a satisfactory experience if the fire generates excessive smoke or excessive ash, or if the fire does not generate sufficient heat for the comfort of the campers. Wood smoke can be irritating to the eyes and lungs, and can greatly diminish the pleasure experienced by a camper. These adverse features are typically the result of incomplete combustion. A hotter fire is cleaner burning and provides more heat.

A portable device which efficiently combusts a wood product with a minimal amount of smoke is desirable.

SUMMARY OF THE INVENTION

Embodiments of the present invention satisfy the need described above, specifically a portable camping stove which provides superior combustion of wood products. An embodiment of the portable camping stove has a cylindrical combustion chamber having a bottom member and circularly configured vertical side wall which extends upwardly from the bottom member and terminates in a top edge. An interior of the combustion chamber is defined by the bottom member, the circularly configured vertical side wall, and the top edge. The bottom member may comprise a sliding panel or hinged door to facilitate the removal of ashes and debris.

The circularly configured side wall has a plurality of spaced-apart vertically oriented slots, where each of the spaced-apart vertically oriented slots extends from the exterior of the combustion chamber through the circularly configured side wall to the interior of the combustion chamber.

A plurality of vertically aligned louver members are disposed in a spiraling configuration about the cylindrical combustion chamber where a portion of each louver member may extend outwardly from the combustion chamber. Each louver member of the plurality of vertically aligned louver members is disposed in a tangential position to a coinciding adjacent vertical slot of the plurality of spaced-apart vertically oriented slots, while a portion of each louver member may extend into an adjacent respective slot.

A top member has a top surface which is bounded by an outside edge, where the outside edge is configured to engage the top edge of the circularly configured vertical side wall of the combustion chamber. The top member has an opening which extends through the top surface. The opening is relatively small with respect to the diameter of the combustion chamber. Air released from the combustion chamber flows through the opening. The relatively small size of the opening limits an air flow from flowing back through the top member and thereby feeding the fire from above. This flow restriction forces a greater volume of air to be drawn in through the slots and louvers in the vertical side wall of the combustion chamber.

The louver members direct air flow into the combustion chamber such that during combustion of the wood product within the cylindrical combustion chamber, a flow of air is drawn past the plurality of vertically aligned louver members through the plurality of spaced-apart vertically oriented slots into the interior of the combustion chamber. With this configuration, when wood products are burned within the combustion chamber, air is drawn into the combustion chamber through the louver members at a direction which is tangential to the cylindrical wall, which creates a mass of whirling air (i.e., a vortex) as the air circulates and rises within the combustion chamber. The circular motion of the air inside the combustion chamber causes a greater retention time of the air within the combustion chamber, which provides further oxygen to the fire and results in more complete combustion, with a cleaner fire and less smoke.

In another embodiment of the invention, the louver members are each pivotable about a respective vertical axis for each louver member.

In another embodiment of the invention, each louver member of the plurality of louver members pivots simultaneously with respect to the other louver members.

In another embodiment of the invention, the simultaneous pivoting of each of the louver members of the plurality of louver members is actuated by a lever.

In another embodiment of the invention, each of the louver members has a gear member integral to the louver member, where the gear member is positioned at the vertical axis of the louver member.

In another embodiment of the invention, a ring gear encircles the combustion chamber, where the ring gear has a plurality of inwardly facing gear teeth, and each of the louver gear members engages a portion of the inwardly facing teeth.

In another embodiment of the invention, the actuation lever is attached to the ring gear.

In another embodiment of the invention, a plurality of leg members are attached to the combustion chamber.

In another embodiment of the invention, a handle member is attached to the top member.

In another embodiment of the invention, the top member may be configured as a truncated cone, with the opening at the center of the top member. The top surface of the top member may be configured from a plurality of overlapping plates. A slot may be defined between each of a pair of adjacent plates. With this configuration, air flow through the top member may contributed to the formation of a vortex inside the combustion chamber.

Embodiments of the present invention may also include an embodiment having a combustion chamber made up of a lower section and an upper section. In this embodiment, both sections of the combustion chamber may have the vertically aligned slots and louver members discussed above, as well as utilizing a top member configured as a truncated cone. In this embodiment, the upper section and top member may be temporarily stored or transported by placing those pieces inside the larger diameter lower section.

Embodiments of the invention may further include a top member which has a smoke conduit connected to the opening. In this embodiment, the smoke conduit may further have internal vanes in a spiral configuration.

BRIEF DESCRIPTION OF THE DRAWINGS

FIG. 8 further shows how a gear member may be connected to each louver member and how a ring gear member may be utilized to simultaneously pivot each of the louver members.

DETAILED DESCRIPTION OF THE INVENTION

Embodiments of the disclosed invention, discussed in greater detail below, provide a portable stove and/or fire pit for containing a campfire for providing heat and light. Because of the structure of the side wall and top, as fuel is consumed and air is drawn into the combustion chamber, a vortex is formed within the device. This vortex provides for a more complete burn of the fuel, thereby increasing the heat generated by the stove, and reducing the amount of smoke generated by the fire.

Figure 1:
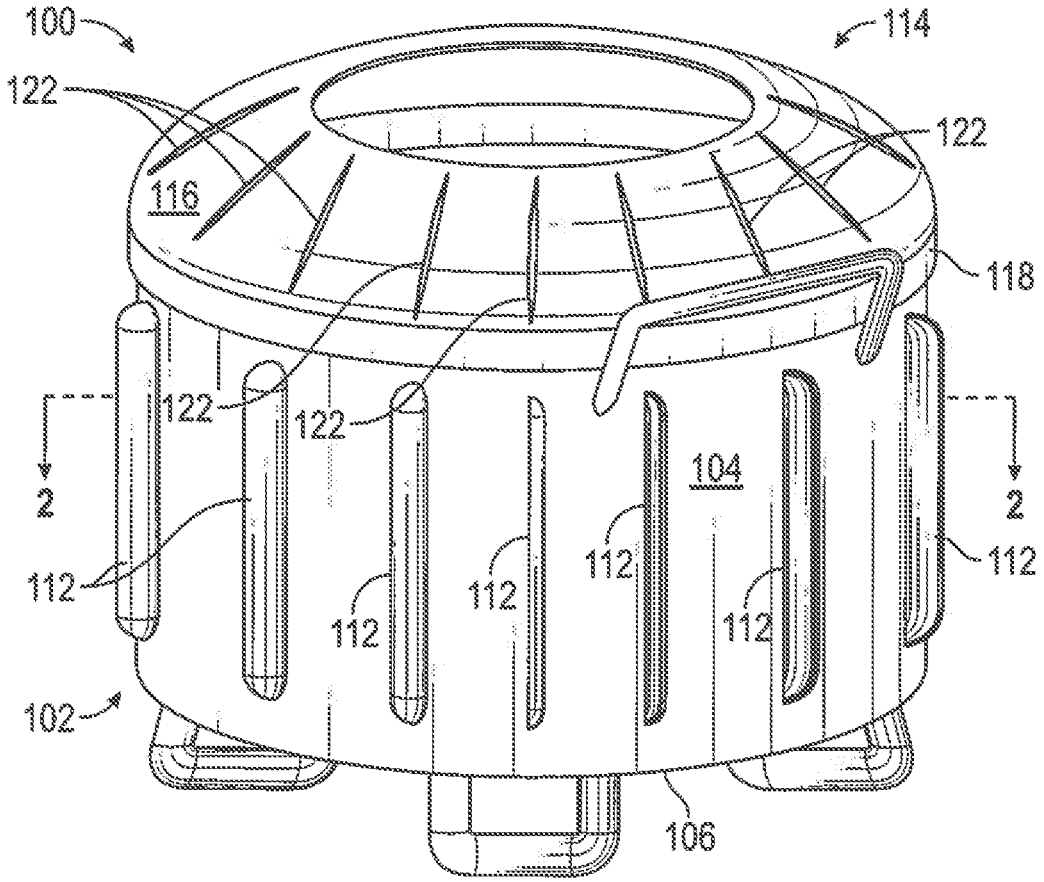
FIG. 1 depicts a side view of an embodiment of the invention.

Turning now to the figures, FIG. 1 depicts a perspective view of a first embodiment 100 of the disclosed portable stove and/or fire pit. Embodiment 100 has a cylindrical combustion chamber 102 which is formed by a circularly configured vertical side wall 104 which extends upwardly from a bottom member 106. Bottom member 106 will typically comprise a flat non-flammable surface which provides support to the wood product to be consumed within the combustion chamber 102. Bottom member 106 may include a sliding or hinge door or panel to facilitate cleaning the inside of combustion chamber 102.

Figure 3:
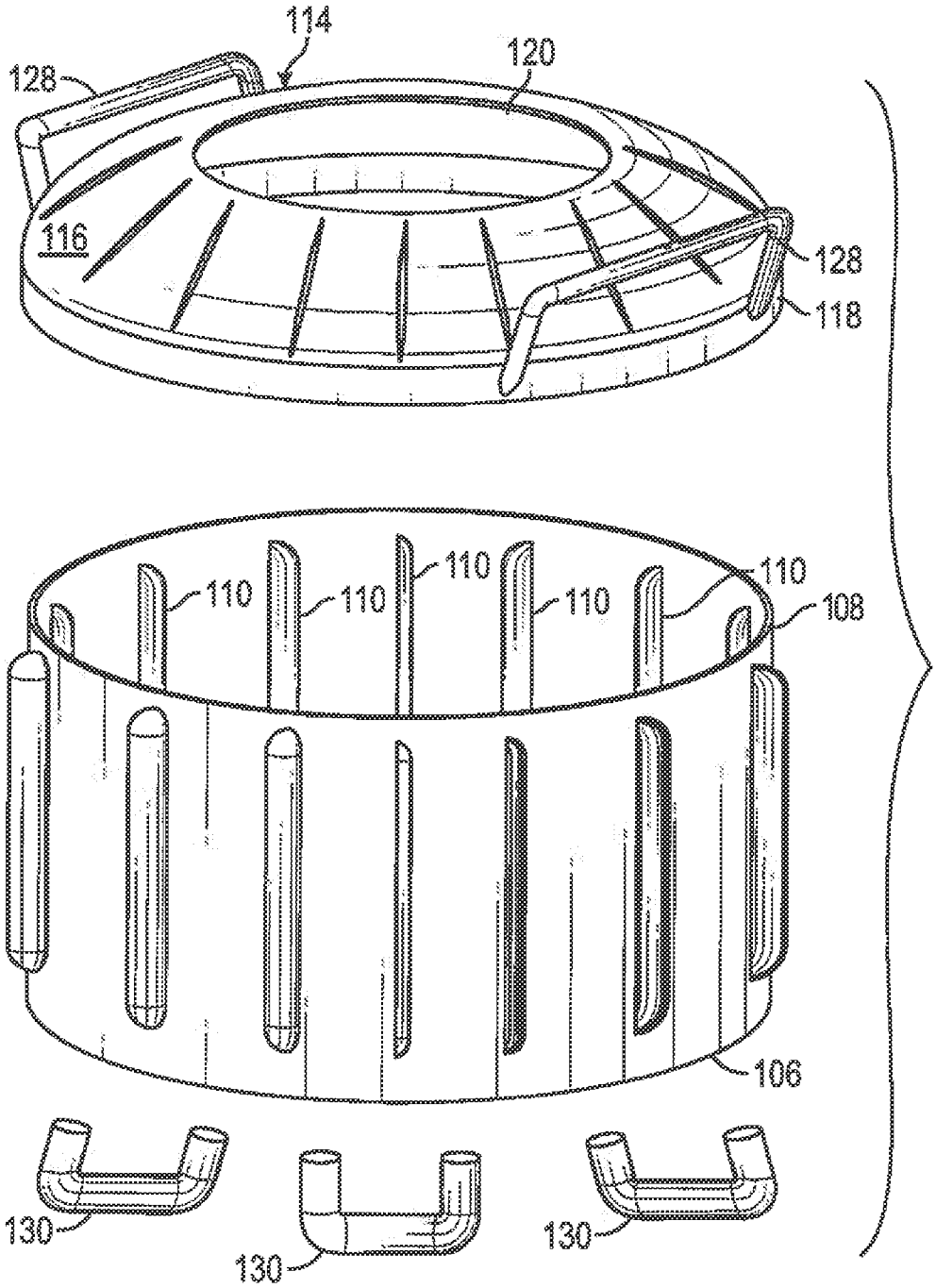
FIG. 3 depicts an exploded view of the embodiment of FIG. 1.

Vertical side wall 104 terminates in top edge 108, best shown in FIG. 3. Circularly configured vertical side wall 104 has a plurality of spaced-apart vertically oriented slots 110, also best shown in FIG. 3. Each of the vertically oriented slots 110 extends completely through vertical side wall 104, allowing air passage from the exterior to the interior of the cylindrical combustion chamber 102, where the interior is defined by the vertical side wall 104, the bottom member 106 and the top edge 108.

This embodiment may also comprise a plurality of vertically aligned louver members 112 which are disposed in a spiraling configuration about the combustion chamber 102. Each of the louver members 112 is disposed tangentially to a respective vertically oriented slot 110. It is to be appreciated that vertically aligned louver members 112 may be formed as separate structural members which extend outwardly from vertical side wall 104 as depicted in FIG. 1. However, louver members 112 may be integral to vertical side wall 104, and formed by contouring vertically oriented slots 110, where a leading edge of the slot may extend outwardly and a trailing edge of the slot may extend inwardly, similar to the embodiment depicted in FIG. 6. In either case, during combustion of a wood product within combustion chamber 102, a flow of air is drawn past the vertically aligned louver members 112 and through the plurality of vertically oriented slots 110 into the interior of the combustion chamber.

In one embodiment, vertically oriented slots 110 will begin approximately 1½ inches above bottom member 106 and will extend upwardly to within approximately 1½ inches below top edge 108. Louver members 112 may be fashioned by bending the edges of the vertically oriented slots 110 as discussed above, with all of the louver members 112 bent to face the same direction about the circumference of the combustion chamber 102. Alternatively, as illustrated in for the embodiments depicted in FIGS. 1 and 4, the louver members may be formed by separate structural members attached to combustion chamber 102.

This embodiment also has a top member 114. Top member 114 has a top surface 116 which is bounded by outside edge 118. Outside edge 118 is configured to engage top edge 108 of the cylindrical combustion chamber 102. Top member 114 has an opening 120 which extends through the top surface 116. Top member 114 may further comprise a plurality of slices 122 which extend in a radial direction along and through top surface 116. Slices 122 will also draw in air as combustion occurs in combustion chamber 102.

Opening 120 is relatively small with respect to the diameter of the combustion chamber 102. For example, if combustion chamber 102 has a diameter of 18 inches, an appropriate diameter for opening 120 is 7½ inches, so an appropriate ratio of combustion chamber diameter to opening diameter is 2.4. The appropriate height for a combustion chamber having an 18 inch diameter is approximately 11 inches. All of these dimensions may be varied, but in order to optimize the generation of the vortex inside the combustion chamber 102, the inventor herein has found it preferable to maintain the approximate ratios between combustion chamber diameter height and diameter, as well as the ratio of the diameter of the opening 120 to the diameter of the combustion chamber.

Figure 2:
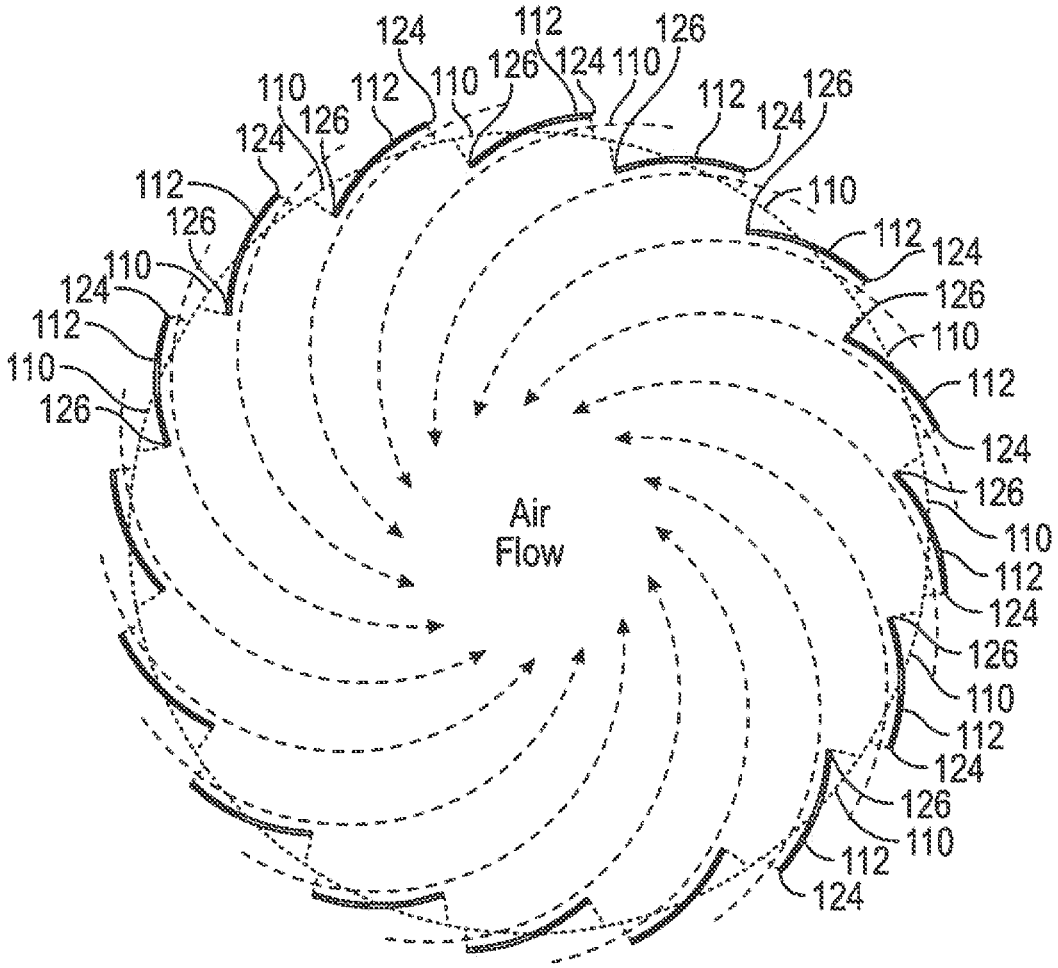
FIG. 2 depicts a view taken along line 2-2 of FIG. 1, showing how the combination of the louver members and slots creates a vortex as air is drawn into the combustion chamber during combustion.

FIG. 2 depicts a view taken along line 2-2 of FIG. 1, showing how the combination of the louver members and slots creates a vortex as air is drawn into the combustion chamber during combustion. FIG. 2 also depicts a configuration of the relationship between slots 110 and louver members 112. Louver members 112 may comprise a leading edge 124 and a trailing edge 126.

FIG. 3 depicts an exploded view of the embodiment of FIG. 1. As further shown in the exploded view, embodiments of the disclosed portable stove and/or fire pit may comprise handle members 128 which attach to top member 114 and leg members 130 which attach to bottom member 106 of the cylindrical combustion chamber 102.

Figure 4:
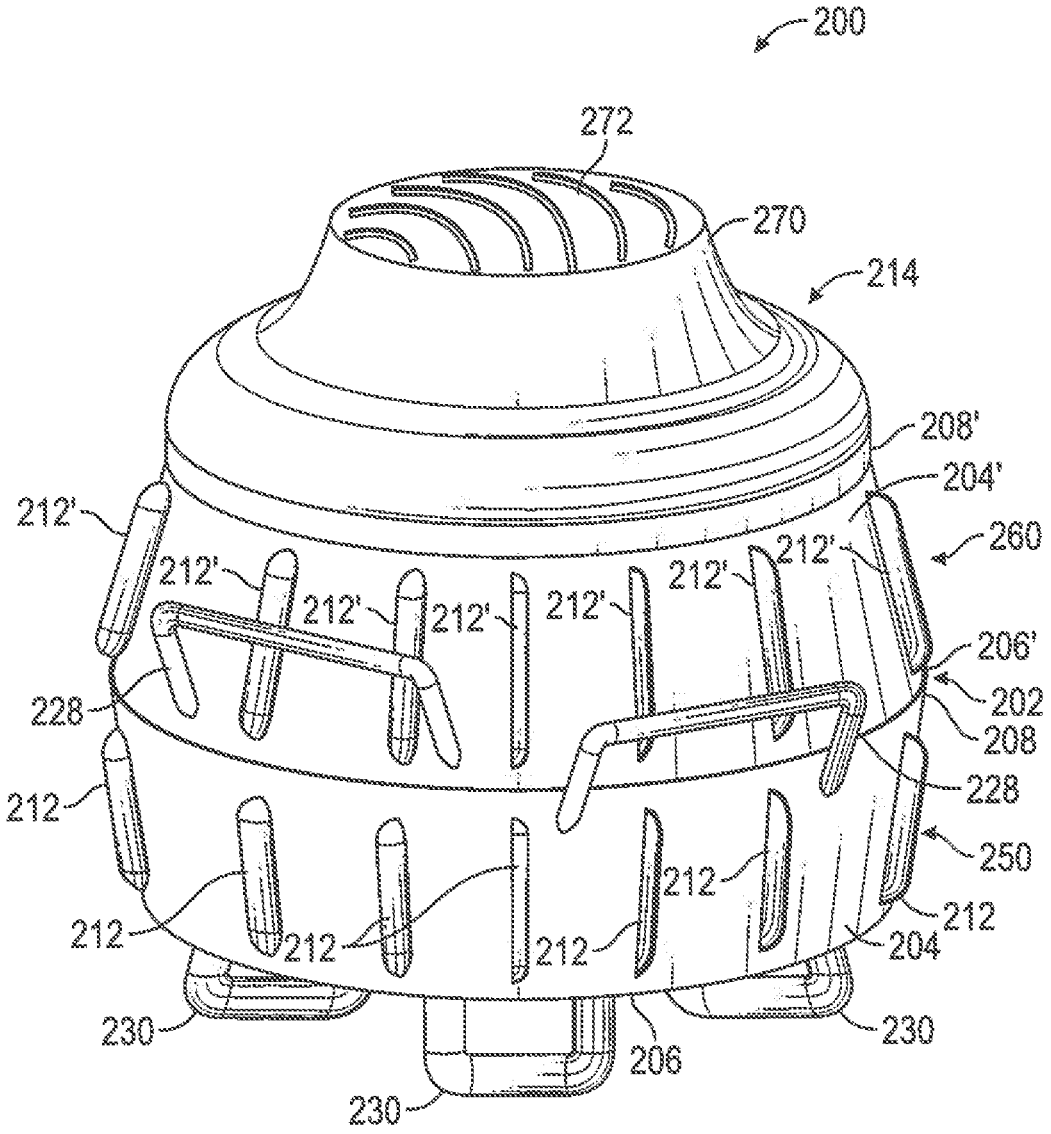
FIG. 4 depicts a side view of a two stage embodiment of the invention.
Figure 5:
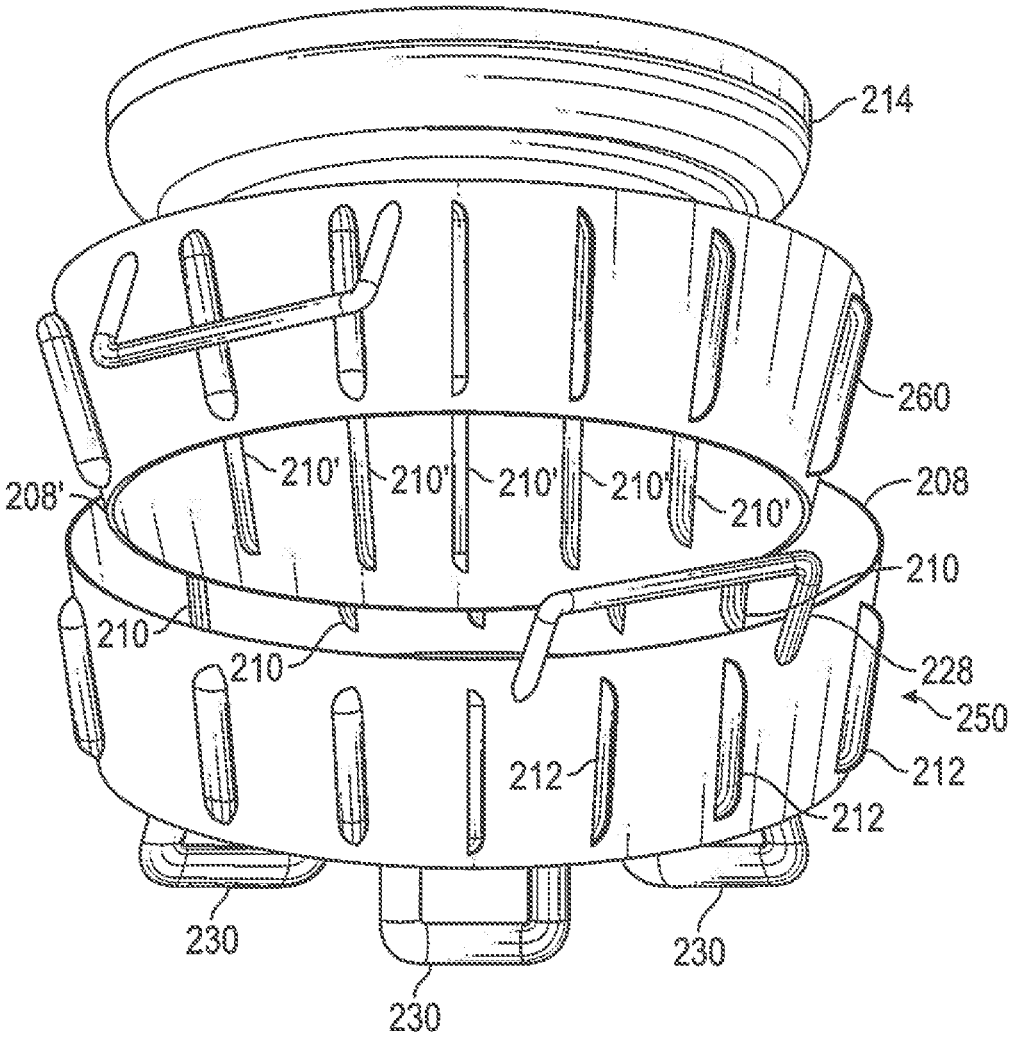
FIG. 5 depicts an exploded view of a two stage embodiment depicted in FIG. 4, showing how the components of the invention may be stacked together for transportation and storage.

FIG. 4 depicts another embodiment 200 of the disclosed portable stove and/or fire pit. Embodiment 200 has a cylindrical combustion chamber 202 which is formed by a bottom section 250 and a top section 260. Bottom section 250 has a first circularly configured vertical side wall 204 which extends upwardly from a bottom member 206. First circularly configured side wall 204 terminates in an upper edge 208, best shown in FIG. 5. Top section 260 has a second circularly configured vertical side wall 204' which is bounded at a top end by a top edge 208' and extends downwardly and terminates in lower edge 206'. Lower edge 206' of top section 260 engages upper edge 208 of bottom section 250. An interior is defined by the bottom member 206, the first circularly configured side wall 204, the second circularly configured side wall 204' and the top edge 208'. As shown in FIG. 5, for storage and transportation, top section 260 (as well as top member 214) may be turned upside down and placed inside bottom section 250. Bottom section 250 may have handles 228 attached to facilitate transporting the entire device.

Bottom member 206 will typically comprise a flat non-flammable surface which provides support to the wood product to be consumed within the combustion chamber 202. Bottom member 206 may include a sliding or hinge door or panel to facilitate cleaning the inside of combustion chamber 202.

First circularly configured vertical side wall 204 of bottom section 250 has a plurality of spaced-apart vertically oriented slots 210 best seen in FIG. 5. Each of the vertically oriented slots 210 extends completely through vertical side wall 204, allowing air passage from the exterior to the interior of the cylindrical combustion chamber 202. Likewise, second circularly configured vertical side wall 204' of top section 260 has a plurality of vertically oriented slots 210', also best seen in FIG. 5.

This embodiment may also comprise a plurality of vertically aligned louver members 212 which are disposed in a spiraling configuration about bottom section 250. Each of the louver members 212 is disposed tangentially to a respective vertically oriented slot 210. It is to be appreciated that vertically aligned louver members 212 may be formed as separate structural members which extend outwardly from vertical side wall 204 as depicted in FIG. 4. However, louver members 212 may be integral to vertical side wall 204, and formed by contouring vertically oriented slots 210, where a leading edge of the slot may extend outwardly and a trailing edge of the slot may extend inwardly, similar to the embodiment depicted in FIG. 6.

This embodiment may also comprise a plurality of vertically aligned louver members 212 which are disposed in a spiraling configuration about bottom section 250. Each of the louver members 212 is disposed tangentially to a respective vertically oriented slot 210. It is to be appreciated that vertically aligned louver members 212 may be formed as separate structural members which extend outwardly from vertical side wall 204 as depicted in FIG. 4. However, louver members 212 may be integral to vertical side wall 204, and formed by contouring vertically oriented slots 210, where a leading edge of the slot may extend outwardly and a trailing edge of the slot may extend inwardly, similar to the embodiment depicted in FIG. 6.

This embodiment may also comprise a plurality of vertically aligned louver members 212' which are disposed in a spiraling configuration about top section 260. Each of the louver members 212' is disposed tangentially to a respective vertically oriented slot 210'. It is to be appreciated that vertically aligned louver members 212' may be formed as separate structural members which extend outwardly from vertical side wall 204' as depicted in FIG. 4. However, louver members 212' may be integral to vertical side wall 204', and formed by contouring vertically oriented slots 210', where a leading edge of the slot may extend outwardly and a trailing edge of the slot may extend inwardly, similar to the embodiment depicted in FIG. 6.

Top member 214 may include a smoke conduit 270 which funnels smoke out of the interior of combustion chamber 202. Smoke conduit 270 may have internal vanes 272 on the interior.

Embodiment 200 may further comprise leg members 230 and handle members 228 on both bottom section 250 and top section 260.

Figure 6:
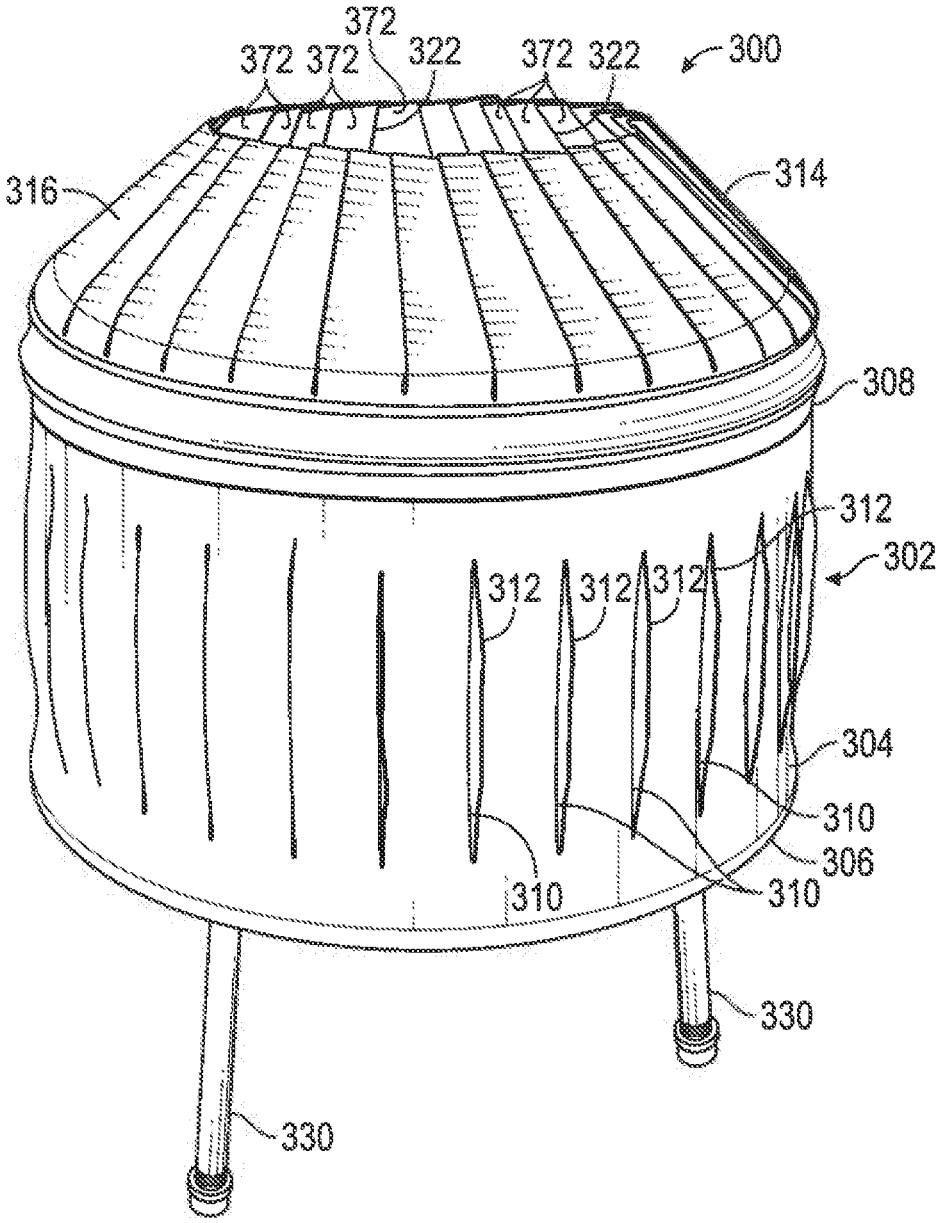
FIG. 6 depicts another embodiment of the invention having a top member having a truncated cone configuration.

FIG. 6 depicts embodiment 300 of the disclosed portable stove and/or fire pit. Embodiment 300 has a cylindrical combustion chamber 302. Cylindrical combustion chamber 302 has a first circularly configured vertical side wall 304 which extends upwardly from a bottom member 306. First circularly configured side wall 304 terminates in an upper edge 308. An interior is defined by the bottom member 306, the circularly configured side wall 304, and the upper edge 308. Bottom member 306 will typically comprise a flat non-flammable surface which provides support to the wood product to be consumed within the combustion chamber 302. Bottom member 306 may include a sliding or hinge door or panel to facilitate cleaning the inside of combustion chamber 302.

Circularly configured vertical side wall 304 has a plurality of spaced-apart vertically oriented slots 310. Each of the vertically oriented slots 310 extends completely through vertical side wall 304, allowing air passage from the exterior to the interior of the cylindrical combustion chamber 302.

Embodiment 300 may also comprise a plurality of vertically aligned louver members 312 which are disposed in a spiraling configuration about cylindrical combustion chamber 302. Each of the louver members 312 is disposed tangentially to a respective vertically oriented slot 310. It is to be appreciated that vertically aligned louver members 312 may be formed as integral to vertical side wall 304 as depicted in FIG. 6, and formed by contouring vertically oriented slots 310, where a leading edge of the slot may extend outwardly and a trailing edge of the slot may extend inwardly, similar to the embodiment depicted in FIG. 6. Vertically aligned louver members 312 may also be formed as separate structural members which extend outwardly from vertical side wall 304 as depicted in FIG. 7.

Top member 314 may be configured as a truncated cone, with opening 320 at the center of the top member. Top surface 316 may be configured from a plurality of overlapping plates 372. A slot 322 may be defined between each pair of adjacent plates 372.

Embodiment 300 may further comprise leg members 330 and a handle member, not shown.

Figure 7:
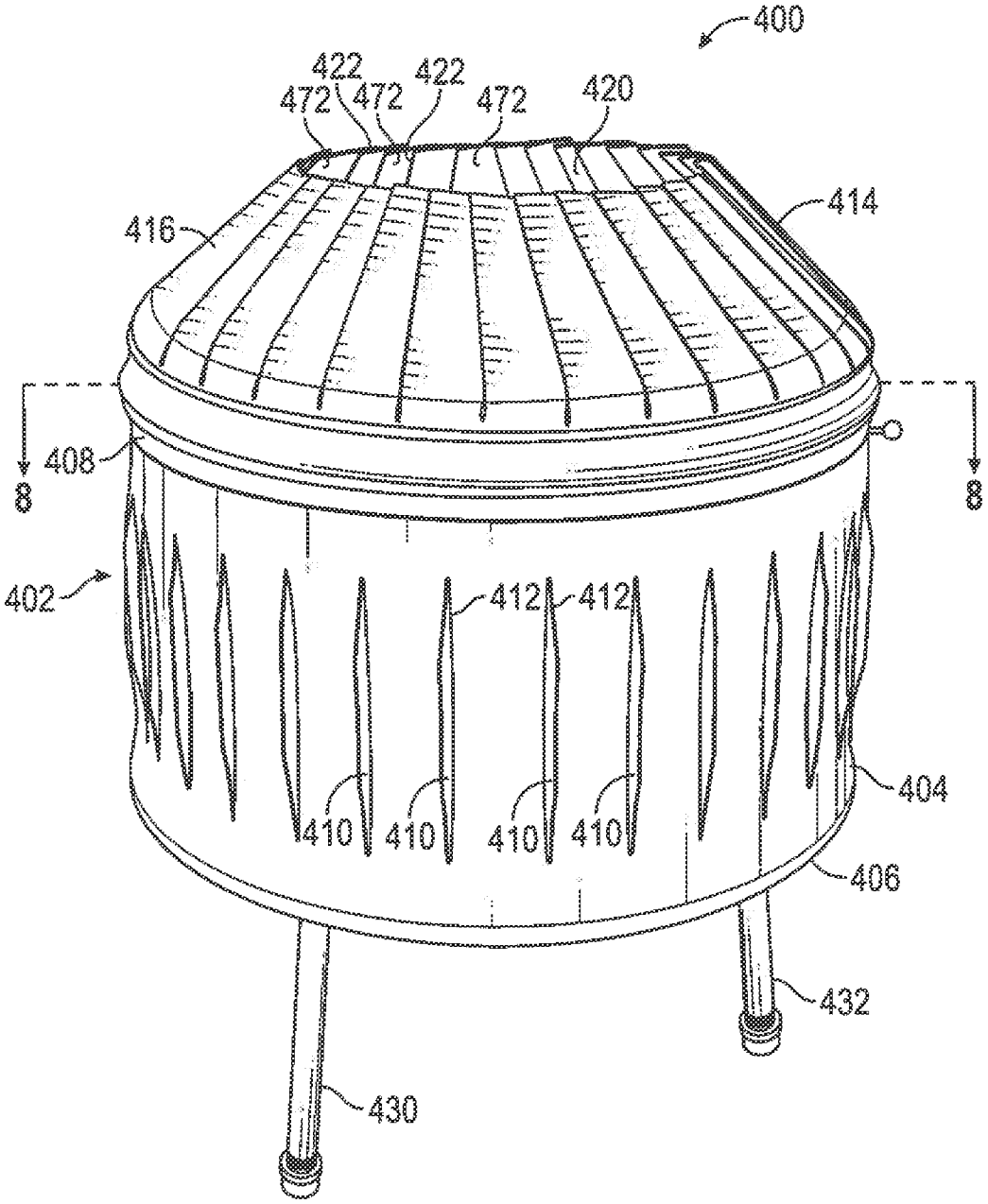
FIG. 7 depicts an embodiment similar to that of FIG. 6, but having adjustable louver members.

FIG. 7 depicts embodiment 400 of the disclosed portable stove and/or fire pit. Embodiment 400 has a cylindrical combustion chamber 402. Cylindrical combustion chamber 402 has a first circularly configured vertical side wall 404 which extends upwardly from a bottom member 406. First circularly configured side wall 404 terminates in an upper edge 408. An interior is defined by the bottom member 406, the circularly configured side wall 404, and the upper edge 408. Bottom member 406 will typically comprise a flat non-flammable surface which provides support to the wood product to be consumed within the combustion chamber 402. Bottom member 406 may include a sliding or hinge door or panel to facilitate cleaning the inside of combustion chamber 402.

Figure 8:
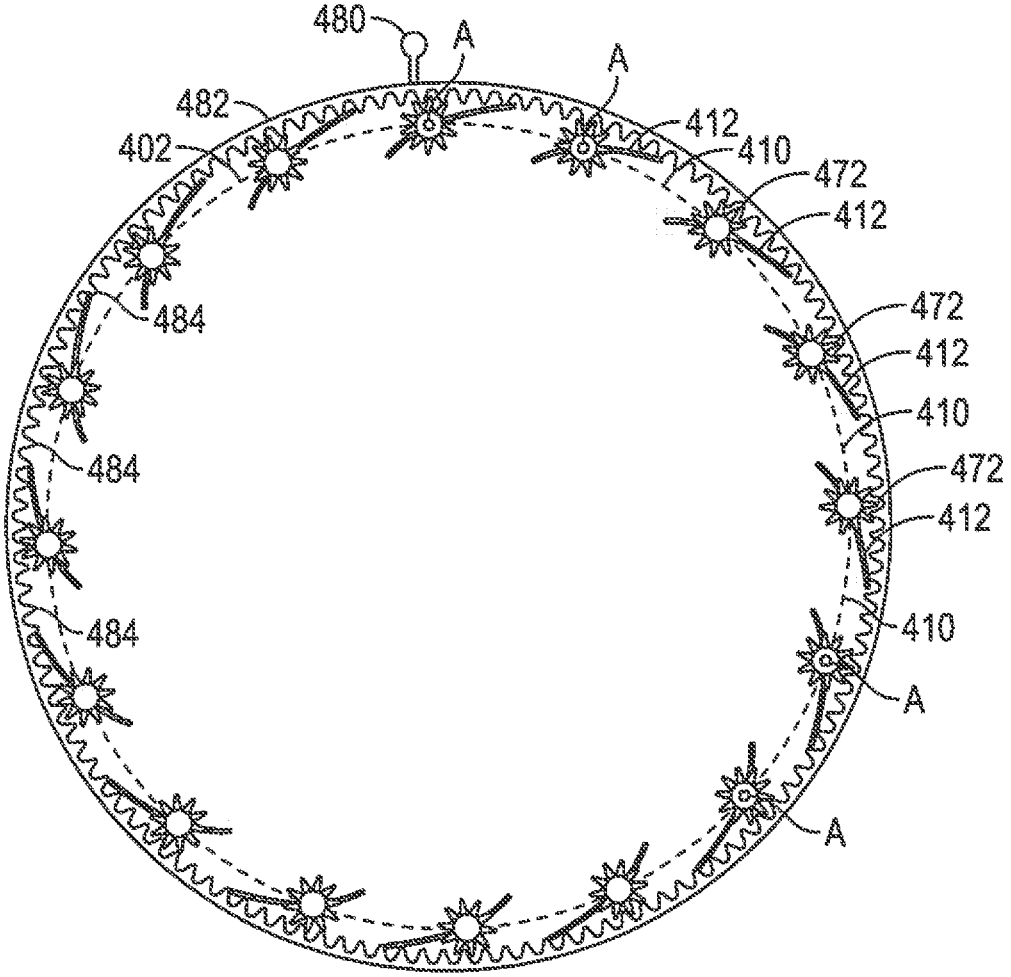
FIG. 8 depicts a view taken along line 8-8 of FIG. 7, showing how, in this embodiment, the louver members are adjustable, where each louver member is pivotable about a vertical axis.

Circularly configured vertical side wall 404 has a plurality of spaced-apart vertically oriented slots 410, as best shown in FIG. 8. Each of the vertically oriented slots 410 extends completely through vertical side wall 404, allowing air passage from the exterior to the interior of the cylindrical combustion chamber 402.

Embodiment 400 may also comprise a plurality of vertically aligned louver members 412 which are disposed in a spiraling configuration about cylindrical combustion chamber 402. Each of the louver members 412 is disposed tangentially to a respective vertically oriented slot 410. Vertically aligned louver members 412 are formed as separate structural members which extend outwardly from vertical side wall 304. As shown in FIG. 8, in this embodiment each louver member 412 is pivotable about a vertical axis A. Each louver member may also have its own gear member 472 which is axially aligned with vertical axis A. Each of the louver members may pivot simultaneously with each of the other louver members and may be pivoted by actuation of lever 480. As further shown in FIG. 8, a ring gear 482 may encircle cylindrical combustion chamber 402. Ring gear 482 may comprise inwardly facing teeth 484 and each of the gear members 472 may engage a portion of the teeth 484 of the ring gear.

Top member 414 may be configured as a truncated cone, with opening 420 at the center of the top member. Top surface 416 may be configured from a plurality of overlapping plates 472. A slot 422 may be defined between each pair of adjacent plates 472.

Embodiment 400 may further comprise leg members 430 and a handle member, not shown.

The embodiments of the invention disclosed herein will be fabricated from non-flammable materials, such as sheet metal and similar materials. In addition to creating a hotter fire with less smoke, combustion within the device forms a vortex motion which captures the remaining smoke and fumes, forcing these to rise straight up above the fire pit, resulting in reduced smoke experienced by those sitting nearby. Unlike open fire pits, or non-vortex fire pits, the wind has much less effect on blowing the smoke around with the disclosed design. The disclosed embodiments catch the wind from any direction with the louvres, stoking the fire, increasing the rate of rotation of the vortex, combusting the fuel even more efficiently, and increasing the height of the vortex above the fire pit, thus forcing the remaining smoke up higher before it is released from the vortex to angle off with the wind—again, reducing the amount of smoke experienced by those sitting near the fire. The increased heat from the fire heats up the metal walls of the cylinder, and radiates outward, creating a very warm area surrounding the fire pit, thus providing more warmth than an open fire.

Having thus described the preferred embodiment of the invention, what is claimed as new and desired to be protected by Letters Patent includes the following:

1. A portable camping stove for combustion of a wood product, the portable camping stove comprising:

a cylindrical combustion chamber comprising a bottom member and circularly configured vertical side wall extending upwardly from the bottom member, the vertical side wall terminating in a top edge, wherein an interior is defined by the bottom member, the circularly configured vertical side wall, and the top edge, wherein the circularly configured side wall comprises a plurality of spaced-apart vertically oriented slots, wherein each of the spaced-apart vertically oriented slots extends through the circularly configured side wall to the interior;

a plurality of vertically aligned louver members disposed in a spiraling configuration about the cylindrical combustion chamber, wherein each louver member of the plurality of vertically aligned louver members is disposed tangentially to a respective vertical slot of the plurality of spaced-apart vertically oriented slots, wherein each louver member is pivotable about a respective vertical axis of the each louver member and wherein each louver member of the plurality of louver members pivots simultaneously with each of the other louver members of the plurality of louver members, wherein the simultaneous pivoting of each of the plurality of louver members is actuated by a lever, wherein during combustion of the wood product within the cylindrical combustion chamber, a flow of air is drawn past the plurality of vertically aligned louver members through the plurality of spaced-apart vertically oriented slots into the interior; and a top member having a top surface which is bounded by an outside edge, the outside edge configured to engage the top edge of the circularly configured vertical side wall thereby partially enclosing the interior, the top member further comprising an opening extending through the top surface.

2. The portable camping stove of claim 1 wherein each of the louver members comprises a gear member positioned at the vertical axis of the each louver member.

3. The portable camping stove of claim 2 wherein a ring gear encircles the cylindrical combustion chamber, wherein the ring gear comprises a plurality of inwardly facing gear teeth, wherein each of the gear members is engaged by a portion of the inwardly facing gear teeth.

4. The portable camping stove of claim 3 wherein the lever is attached to the ring gear.

5. The portable camping stove of claim 1 further comprising a plurality of leg members attached to the cylindrical combustion chamber.

6. The portable camping stove of claim 1 wherein the plurality of vertically aligned louver members are integral to the circularly configured vertical side wall.

7. The portable camping stove of claim 1 wherein the top member is configured as a truncated cone.

8. The portable camping stove of claim 7 wherein the top surface of the top member comprises a plurality of overlapping plates.

9. The portable camping stove of claim 8 wherein a slot is defined between each of a pair of adjacent overlapping plates.

10. The portable camping stove of claim 1 wherein the top surface comprises a plurality of radially extending slices.

11. A portable camping stove for combustion of a wood product, the portable camping stove comprising:

a combustion chamber comprising a bottom section and a top section, the bottom section comprising a bottom member and a first circularly configured vertical side wall extending upwardly from the bottom member and terminating in an upper edge; the top section comprising a second circularly configured side wall, the second circularly configured side wall bounded at a top end by a top edge, the second circularly configured side wall extending downwardly from the top end and terminating in a lower edge, wherein the lower edge of the top section engages with the upper edge of the bottom section;

wherein an interior is defined by the bottom member, the first circularly configured side wall, the second circularly configured side wall, and the top edge, wherein the first circularly configured side wall and the second circularly configured side wall each comprise a plurality of spaced-apart vertically oriented slots, wherein each of the spaced-apart vertically oriented slots in the first circularly configured side wall and the second circularly configured side wall extends into the interior;

a plurality of vertically aligned louver members disposed in a spiraling configuration about the combustion chamber, wherein each louver member of the plurality of vertically aligned louver members is disposed tangentially to a respective vertical slot of the plurality of spaced-apart vertically oriented slots, wherein during combustion of the wood product within the combustion chamber, a flow of air is drawn past the plurality of vertically aligned louver members through the plurality of spaced-apart vertically oriented slots to the interior; and a top member having an outside edge which bounds a top surface, the outside edge configured to engage the top edge of the circular configured vertical side wall thereby partially enclosing the interior, the top member further comprising an opening extending through the top surface.

12. The portable camping stove of claim 11 wherein the top member is configured as a truncated cone.

13. The portable camping stove of claim 12 wherein the top surface of the top member comprises a plurality of overlapping plates.

14. The portable camping stove of claim 13 wherein a slot is defined between each of a pair of adjacent overlapping plates.

15. The portable camping stove of claim 11 wherein the plurality of vertically aligned louver members are integral to the circularly configured vertical side wall.

16. The portable camping stove of claim 11 wherein the top member comprises a smoke conduit connected to the opening, the smoke conduit extending upwardly from the top surface.

17. The portable camping stove of claim 16 wherein the interior of the smoke conduit comprises internal vanes in a spiral configuration.

* * * * *